United States Patent [19]

Martin

[11] 4,354,338

[45] Oct. 19, 1982

[54] FENDER BENDING ATTACHMENT

[76] Inventor: Vernon E. Martin, 504 Sunland Dr., Clovis, N. Mex. 88101

[21] Appl. No.: 117,217

[22] Filed: Jan. 25, 1980

[51] Int. Cl.[3] ..... B68C 3/00

[52] U.S. Cl. ..... 54/47

[58] Field of Search ..... 54/44, 1, 45, 46, 47; 248/225.4, 226.3, 226.5

[56] References Cited

U.S. PATENT DOCUMENTS

| | | | |
|---|---|---|---|
| 199,498 | 1/1878 | Blincoe | 54/47 X |
| 1,995,574 | 3/1935 | Metz | 248/226.5 |
| 2,253,847 | 8/1941 | Crum | 248/226.5 |
| 2,978,855 | 4/1961 | Horst | 54/47 |
| 4,186,903 | 2/1980 | Fazakerley | 248/226.5 X |

*Primary Examiner*—Gene Mancene
*Assistant Examiner*—Robert P. Swiatek
*Attorney, Agent, or Firm*—Harvey B. Jacobson

[57] ABSTRACT

A fender bending attachment comprises a first leg having a pair of opposed, abrasive engagement surfaces spaced laterally a distance approximately equal to the thickness of the fender of a saddle, such abrasive surfaces serving to engage opposite sides of the fender to hold the attachment in place. A second leg is disposed at an angle of approximately 90° or less to the first leg and is positioned directly above the stirrup to hold the portion of the fender mounting the stirrup transversely to the natural plane of the fender. A third leg extends rearwardly from the second leg at the distal end thereof and abuts the edge of a portion of the fender being bent. The third leg and a portion of the first leg actually rest on the top of the stirrup while the opposed abrasive surfaces serve to hold the forward end of the first leg against the fender.

12 Claims, 4 Drawing Figures

FENDER BENDING ATTACHMENT

BACKGROUND OF THE INVENTION

1. Field of the Invention

The invention relates to devices for bending the portion of the fender of a saddle holding a stirrup to a position which is more convenient for a rider's use.

2. Discussion of Related Art

In the early days, during cattle drives, cowboys would take a new saddle with fender and stirrup attached and soak the fender and stirrup in a stock tank. The fender would be twisted until the stirrupt was positioned at a right angle to the original plane of the fender thereby creating a typical riding condition. Of course, such soaking of the leather causes premature deterioration thereof together with unsightly staining of the leather. Present saddles, especially show saddles, have values in excess of $1500.00. Thus, the user has great incentive to keep the saddle in excellent condition and such soaking of the leather would therefore be prohibited.

Most cowboys work their horses with old saddles which, due to extensive use, have the stirrups at right angles to the fender. Then when they go to a hose shown with a new saddle, they find that the stirrup is not at right angles to the fender but is aligned straight with the fender making it difficult to perform and to have a proper boot position in the stirrup. Such a proper boot positioning can be a decisive factor in the outcome of a contest. Accordingly, a need has developed for an article which can hold the stirrup of a relatively unused saddle in the optimum position relative to the fender.

In order to provide proper positioning of the stirrup, several mechanisms have been suggested. For instance, U.S. Pat. No. 2,532,082, issued Nov. 28, 1950 to Borst, shows a stirrup having a swivel attachment for connection to the saddle fender. Accordingly, the stirrup can be oriented easily in any direction desired. U.S. Pat. No. 3,827,215, issued Aug. 6, 1974 to Edenfield, shows a horse saddle stirrup setter comprising a pair of straight handles positioned adjacent each other, one end of each handle having an opening therethrough for receiving a bolt fitted with a wing nut so that the handles can be forcibly brought toward each other. The opposite end of one of the handles has a pair of extending prongs and the other handle has at its opposite end a U-shaped collar. The prongs and the collar are adapted to seize a portion of the fender so that the stirrup is maintained in a suitable position for receiving the rider's foot.

SUMMARY OF THE INVENTION

One object of the present invention is to provide a simple, effective device for attachment to a saddle fender for holding a stirrup in a suitable riding position.

Another object of the present invention is to provide an attachment for the fender of a saddle, which attachment can easily be added and removed from the fender.

Yet a still further object of the present invention is to provide an attachment for bending a saddle fender, which attachment is of a unitary construction in order to provide ease of manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
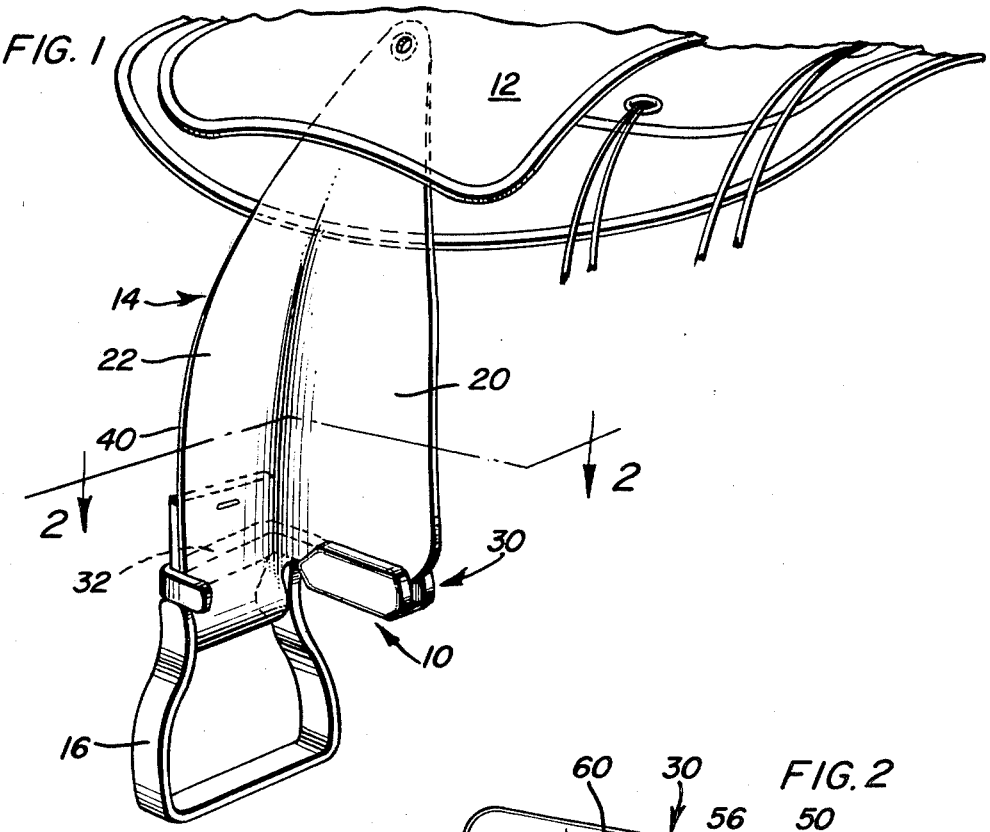
FIG. 1 is a perspective view of a fender bending attachment forming the present invention in use on a saddle fender.

Now with reference to the drawings, a fender bending attachment incorporating the principles and concepts of the present invention and generally referred to by the reference numeral 10 will be described in detail. With particular reference to FIG. 1, there will be seen a saddle 12 and its fender attachment 14 which supports stirrup 16 in a depending position. When the saddle 12 and fender are new, the fender is generally planar and lies alongside the mounted horse with stirrup 16 facing the horse. Thus, it is necessary to bend the fender 14 into two segments, one segment 20 which lies alongside the horse and the other segment 22 which actually supports the stirrup 16 and extends perpendicularly away from the horse thus allowing stirrup 16 to be positioned transversely of the horse with the opening in the stirrup positioned in the normal riding position. The fender bender 10 accomplishes this by connection of a first leg 30 to the fender portion 20 and the disposition of a second leg 32 about the rear of fender portion 22. A third leg 34 is attached to the distal end of leg 32 and abuts the outer edge 40 of fender section 22 to hold that section within the confines of the fender bender 10.

Figure 2:
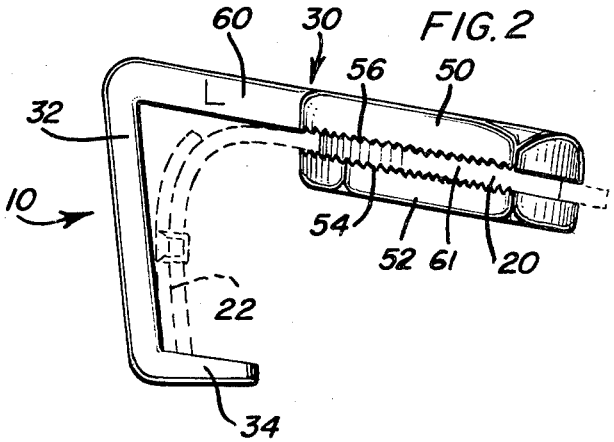
FIG. 2 is a top plan view of the fender bending attachment taken substantially along the plane passing through section lines 2—2 of FIG. 1.
Figure 3:
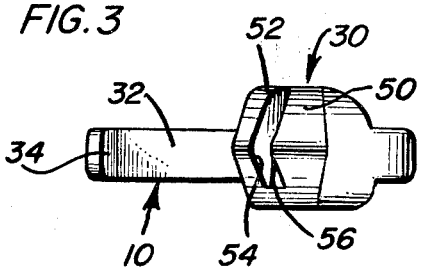
FIG. 3 is a rear elevational view of the fender bending attachment.
Figure 4:
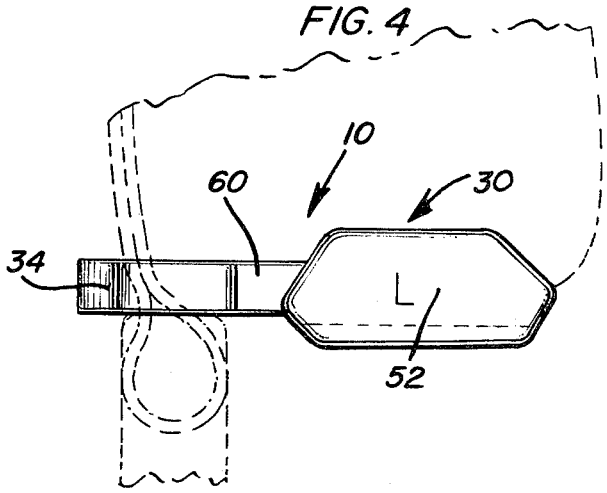
FIG. 4 is a side elevational view of the fender bending attachment.

With reference to FIGS. 2–4, it can be seen that the first leg 30 of the fender bender includes a rear section having a slot composed of two substantially parallel walls 50 and 52 connected by a horizontal web 61 and which extend for more than half the length of the leg and contain abraded opposing internal surfaces 54 and 56 which actually contact the fender section 20 and securely hold the fender bender against the fender. A reduced portion 60 of the leg 30 extends forwardly of the walls 50 and 52 and is attached directly to the second leg 32 which extends laterally from leg 30 at an angle of 90° or less in order that the fender section 22 can be held at an optimum 90° angle.

Obviously, the fender bender 10 shown in FIGS. 1–4 is designed for use on the left side of the saddle as indicated by the "L" imprinted thereon and shown in FIGS. 2 and 4. A fender bending attachment for the right side of the saddle would simply be an inverted device having the same characteristics as attachment 10.

The fender bender 10 can easily be formed in a one-piece, unitary construction thus making it amenable to formation in a single plastic mold to reduce cost thereof. If necessary, an abrasive material can be applied on surfaces 54 ad 56 to insure proper engagement with the portion 20 of the fender itself. Alternatively, the device can be carved from wood, shaped from metal or manufactured from any other suitable materials, as desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A device for attaching to a saddle fender so as to orient a stirrup in an appropriate direction for riding, said device comprising:

a first leg portion having a slot formed therein, said slot having opposed abrasive surfaces for gripping said fender; and a second leg portion fixedly secured to said first leg portion and extending laterally therefrom, said second leg portion serving to retain said fender in a bent position so as to orient said stirrup in said appropriate direction for riding.

2. The device as defined in claim 1 wherein said second leg portion has a distal end, and further including a third leg portion attached to said second leg portion at said distal end thereof, said third leg portion being oriented approximately in a direction parallel to said first leg portion.

3. The device as defined in claim 2 wherein said first and second leg portions are oriented substantially orthogonally to each other.

4. An attachment for a saddle for orienting a stirrup in an appropriate direction for riding, said attachment comprising:

two leg portions, one of said leg portions having a slot formed therein, said slot having opposed abrasive surfaces and the other of said leg portions extending laterally from said first leg portion, said other of said leg portions having a distal end, and further including a third leg portion attached to the other of said leg portions at said distal end thereof, said third leg portion being oriented approximately in the direction of said one of said leg portions, said one leg portion and said other of said leg portions being oriented at 90° or less to each other, and further wherein said one of said leg portions has an enlarged portion, said slot being formed in said enlarged portion, said enlarged portion being disposed towards the rear of said one of said leg portions with the forward portion of said one of said leg portions being attached to the proximal portion of said other of said leg portions.

5. A device for attachment to a saddle fender for orienting a stirrup in a predetermined direction for riding comprising:

a first leg portion having a first wall means generally coplanar with said first leg portion;

a second leg portion fixedly secured to said first leg portion and extending in a direction laterally therefrom, said second leg portion serving to retain a saddle fender in a predetermined direction for riding;

a horizontal web fixedly secured to said first leg portion extending laterally in the same direction as said second leg portion for at least the thickness of the saddle fender; and second wall means extending upwardly from the web in a direction generally parallel to said first wall means for encompassing said fender for retaining it in orientation and alignment with respect to the predetermined direction for riding.

6. The device for attaching to a saddle fender so as to orient a stirrup in an appropriate direction for riding as defined in claim 5, wherein said second leg portion serves to effect a bending of said fender in a manner which causes said orienting of said stirrup in said appropriate direction for riding.

7. The device for attaching to a saddle fender so as to orient a stirrup in an appropriate direction for riding as defined in claim 6, wherein said first wall means and said second wall means include gripping means positionable about an edge portion of said fender so as to retain said device in attachment therewith.

8. The device for attaching to a saddle fender so as to orient a stirrup in an appropriate direction for riding as defined in claim 7, wherein said gripping means includes a use of a slot formed in said device into which said edge portion of said fender is removably securable.

9. The device for attaching to a saddle fender so as to orient a stirrup in an appropriate direction for riding as defined in claim 8, wherein said slot is provided with at least one abrasive surface so as to facilitate a retaining of said edge portion of said fender within said slot.

10. The device for attaching to a saddle fender so as to orient a stirrup in an appropriate direction for riding as defined in claim 6, wherein said second leg portion includes a bent back portion on a distal end thereof so as to further facilitate a positioning and retention of said fender relative to said laterally extending member.

11. A device for attaching to a saddle fender so as to orient a stirrup in an appropriate direction for riding as defined in claim 5 wherein said first wall means, said web and said second wall means comprise an enlarged portion having a slot formed therein, said slot serving to receive an edge portion of said fender so as to effect attaching of said device to said fender.

12. The device for attaching to a saddle fender so as to orient a stirrup in an appropriate direction for riding as defined in claim 11, wherein said slot is provided with at least one abrasive surface so as to further facilitate a retention of said edge portion of said fender within said slot.

* * * * *